US006965066B1

(12) United States Patent
Lace et al.

(10) Patent No.: US 6,965,066 B1
(45) Date of Patent: Nov. 15, 2005

(54) ELONGATED STRING SUPPORT FOR A STRINGED MUSICAL INSTRUMENT

(75) Inventors: Jeffrey J. Lace, Huntington Beach, CA (US); Donald A. Lace, Jr., Long Beach, CA (US)

(73) Assignee: Actodyne General, Inc., Huntington Beach, CA (US)

( * ) Notice: Subject to any disclaimer, the term of this patent is extended or adjusted under 35 U.S.C. 154(b) by 54 days.

(21) Appl. No.: 10/345,109

(22) Filed: Jan. 15, 2003

Related U.S. Application Data

(60) Provisional application No. 60/350,305, filed on Jan. 16, 2002.

(51) Int. Cl.[7] ..... G10D 3/00

(52) U.S. Cl. ..... 84/293

(58) Field of Search ..... 84/290, 239.1, 84/267, 292, 293.8, 293, 314 R

(56) References Cited

U.S. PATENT DOCUMENTS

| | | | | | |
|---|---|---|---|---|---|
| 554,828 | A | | 2/1896 | Maldura | |
| 1,290,177 | A | | 1/1919 | Grimson | |
| 2,816,469 | A | | 12/1957 | Gossom | |
| 2,960,900 | A | | 11/1960 | Fender | |
| D203,301 | S | | 12/1965 | Frazier | |
| 3,251,258 | A | | 5/1966 | Parker | |
| D207,506 | S | | 4/1967 | Kager | |
| 3,319,504 | A | | 5/1967 | Appleton | |
| 3,398,622 | A | | 8/1968 | Smith | |
| 3,426,638 | A | | 2/1969 | Smith | |
| 3,688,632 | A | | 9/1972 | Perez | |
| 3,691,285 | A | | 9/1972 | Larrison | |
| 3,739,072 | A | | 6/1973 | Smith | |
| 3,785,239 | A | | 1/1974 | Smith | |
| 4,023,460 | A | | 5/1977 | Kuhnke | |
| 4,132,143 | A | * | 1/1979 | Stone | 84/314 R |
| 4,311,078 | A | | 1/1982 | Falgares | |
| D274,733 | S | | 7/1984 | Hampton et al. | |
| 4,534,260 | A | | 8/1985 | Burrell | |
| 4,635,522 | A | | 1/1987 | Excellente | |
| 4,777,858 | A | * | 10/1988 | Petschulat et al. | 84/314 R |
| 4,852,450 | A | | 8/1989 | Novak | |
| 4,919,029 | A | | 4/1990 | Excellente | |
| 5,078,037 | A | | 1/1992 | Sutcliffe et al. | |
| 5,113,737 | A | | 5/1992 | Grerory | |
| D327,700 | S | | 7/1992 | Wintz | |
| 5,133,239 | A | | 7/1992 | Thomas | |
| 5,347,904 | A | | 9/1994 | Lawrence | |
| D363,946 | S | | 11/1995 | Eberlen | |
| D372,491 | S | | 8/1996 | DeCola | |
| 5,571,980 | A | | 11/1996 | Busley | |
| 5,739,444 | A | | 4/1998 | Borisoff | |
| 5,852,249 | A | | 12/1998 | Steinberg et al. | |
| 5,994,633 | A | * | 11/1999 | Norton | 84/290 |
| D422,015 | S | | 3/2000 | Steinberg et al. | |
| 6,034,308 | A | | 3/2000 | Little | |
| D431,589 | S | | 10/2000 | Steinberg et al. | |

* cited by examiner

*Primary Examiner*—Kimberly Lockett
(74) *Attorney, Agent, or Firm*—Bliss McGlynn, P.C.

(57) ABSTRACT

An elongated string support for a stringed musical instrument includes a neck having a heel portion, a head portion, and a finger-board portion extending axially between the heel portion and the head portion. The finger-board portion has a spiral profile from the heel portion to the head portion. The elongated string support also includes a finger-board attached to the neck and having a heel end and a nut end. The finger-board has a spiral profile from the heel end to the nut end. The neck and the finger-board are zero degrees from a heel thereof and to a predetermined angle greater than zero degrees at a nut thereof.

20 Claims, 2 Drawing Sheets

ELONGATED STRING SUPPORT FOR A STRINGED MUSICAL INSTRUMENT

CROSS-REFERENCE TO RELATED APPLICATION(S)

The present invention claims the priority date of copending U.S. Provisional Patent Application Ser. No. 60/350,305, filed Jan. 16, 2002.

BACKGROUND OF THE INVENTION

1. Field of the Invention

The present invention relates generally to stringed musical instruments and, more particularly, to an elongated string support for strings of a stringed musical instrument.

2. Description of the Related Art

Stringed musical instruments, such as guitars, generally include a body formed with an elongated string support, typically known as a "neck", for strings and a headstock at one end of the neck. The strings are tensioned over a bridge on the body at one end and a nut at the other end adjacent the headstock. The headstock usually incorporates a string tension adjusting mechanism. The neck typically includes a fretboard or finger-board which provides a player of the stringed musical instrument with a choice of selecting individual notes or chords by depressing manually the string or strings onto the finger-board, thereby effectively shortening them.

The practice of string bending is extremely common among players of stringed musical instruments. The reason for bending strings is to actively raise the pitch of a note over time, creating a desirable audio effect. Some players bend strings predominately in an upward direction (i.e., pushing the higher strings up) while others bend strings predominately in a downward direction (i.e., pulling the lower strings down).

Conventionally, the neck and finger-board are formed so as to lie in a straight plane which remains fixed in relation to a plane of the body and without any twisting. Stringed musical instrument manufactures have always placed a heavy emphasis on the straightness and accuracy of the neck and finger-board. The accuracy with which the neck is manufactured is important in providing an acceptable "action" or relationship between the strings and the finger-board whether fretted or fretless. However, the traditional straight neck can cause the player to suffer stress of the wrist joint when accessing complex chord formations particularly at the distal end of the head-stock, due to the need for continuous finger-hand-wrist adjustment coupled with a high degree of wrist flexion. This continued excessive flexion of the wrist can cause a range of repetitive strain injuries such as Carpal Tunnel Syndrome, tendonitis, and tenosynovitis. These injuries are well documented as common in professional and frequent recreational players of stringed musical instruments.

One attempt to solve the above has been to relate the neck relative to the bridge on the body of the stringed musical instrument. Such an example is disclosed in U.S. Pat. No. 4,534,260 to Burrell. This patent discloses a stringed musical instrument having a bridge and neck rotated relative to one another about a longitudinal axis of the neck. The bridge may be flat or crowned. The stringed musical instrument has a fretboard twisted progressively throughout its length to correspond to the rotation.

One disadvantage of the above-patented stringed musical instrument is that during the actual playing of the instrument with such a neck/finger-board, the player can inadvertently and undesirably "choke" the vibration of the strings while undertaking the common practice of "bending" strings. For example, the string or strings being fretted and "bent" down will invariably come into contact with one or more of the higher frets, thus "choking" or damping the string's vibrations and inevitably causing the strings to buzz against the higher frets or stopping the sustain of the note completely. This disadvantage is even more apparent if the action of the stringed musical instrument has been set very low, i.e., the strings are adjusted to be as close as possible to the frets. This disadvantage also arises when players of such a stringed musical instrument generate vibrato effects by both pushing and pulling the fretted strings across the frets rapidly.

To solve these disadvantages, an elongated string support has been provided for the stringed musical instrument with a finger-board surface that follows a longitudinally twisted path and has a non-uniform radius on the elongated string support. Such an example is disclosed in U.S. Pat. No. 5,852,249 to Steinberg et al. This patent discloses a stringed musical instrument having an elongated string support including a finger-board surface having a bass side and a treble side and extending between a proximal end and a distal end relative to the stringed musical instrument to support strings in close proximity thereto. The elongated string support follows a longitudinally twisted path with an angle of twist increasing progressively from the proximal end to the distal end. The finger-board surface has a non-uniform radius extending between at least either one of the bass side and the treble side and one of the proximal end and the distal end.

One disadvantage of the above patented elongated string support is that it is difficult to manufacture the elongated string support and body of the stringed musical instrument as one-piece. Another disadvantage is that finger-board geometry for the low E, A, and D strings causes the strings to buzz according to a particular playing style. Yet another disadvantage is that a saddle on the bridge is set at a maximum height for the low E string, thus eliminating any adjustability of the saddle.

SUMMARY OF THE INVENTION

It is, therefore, one object of the present invention to provide a new elongated string support for a stringed musical instrument having a spiral profile which allows the instrument to be played over the length of the string support with the wrist flexion maintained in a relatively neutral position.

It is another object of the present invention to provide an elongated string support for a stringed musical instrument having a spiral profile that is easier to manufacture and can be retrofitted to conventional stringed musical instruments.

It is yet another object of the present invention to provide an elongated string support for a stringed musical instrument having a spiral profile that allows adjustability of the saddle of the stringed musical instrument.

It is a further object of the present invention to provide an elongated string support for a stringed musical instrument having a spiral profile, which allows the instrument to be played far more comfortably and at a satisfactory level.

To achieve the foregoing objects, the present invention is an elongated string support for a stringed musical instrument including a neck having a heel portion, a head portion, and a finger-board portion extending axially between the heel portion and the head portion. The finger-board portion has a spiral profile from the heel-portion to the head portion. The elongated string support also includes a finger-board attached to the neck and having a heel end and a nut end. The finger-board has a spiral profile from the heel end to the nut end. The neck and the finger-board are zero degrees from a heel thereof and to a predetermined angle greater than zero degrees at a nut thereof.

One advantage of the present invention is that an elongated string support is provided for a stringed musical instrument that is spiraled from a heel to a nut thereof. Another advantage of the present invention is that the elongated string support has a variety of applications and is applicable to stringed musical instruments including, but not limited to, both acoustic and electric guitars, violins, banjos, cellos, and the like and can be applied to twisted finger-boards of either the fretted of fretless type. Yet another advantage of the present invention is that the player of the stringed musical instrument avoids having to play complex (e.g., barre) chords requiring significant finger pressure, with a highly flexed ("cocked") wrist, particularly at the distal end of the neck, thereby avoiding excessive wrist strain because the player's wrist is maintained in a substantially neutral position at all points along the finger board. Still another advantage of the present invention is that the elongated string support has a spiraled profile to maintain a substantially straight low E string. A further advantage of the present invention is that the elongated string support is manufactured in more than one piece, which allows for easier manufacturability. Yet a further advantage of the present invention is that the elongated string support may be retrofitted to conventional stringed musical instruments. Still a further advantage of the present invention is that the elongated string support has a spiral profile that allows the saddle on the bridge to be adjusted so that the strings are closer to the frets while reducing "fret buzz" and "choking" and allowing the stringed musical instrument to be played comfortably.

Other objects, features, and advantages of the present invention will be readily appreciated, as the same becomes better understood, after reading the subsequent description taken in conjunction with the accompanying drawings.

DESCRIPTION OF THE PREFERRED EMBODIMENT(S)

Figure 1:
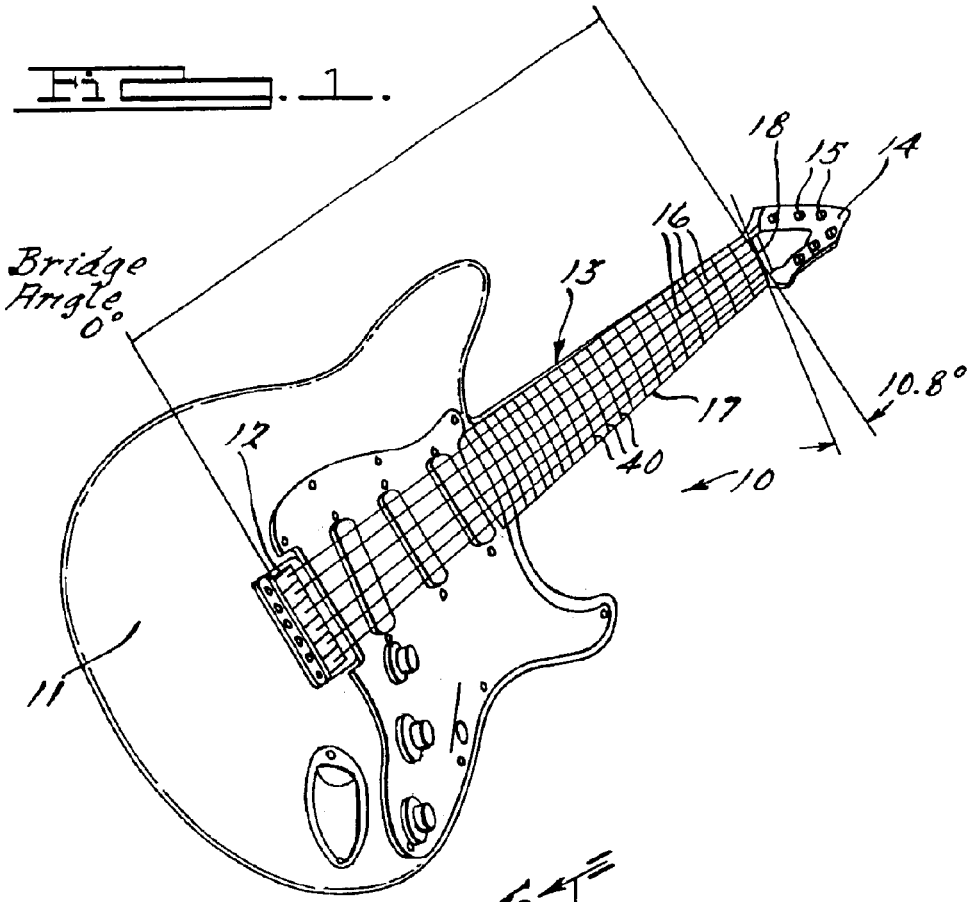
FIG. 1 is a perspective view of a right-handed stringed musical instrument that has an elongated string support, according to the present invention.

Referring to FIG. 1, one embodiment of a stringed musical instrument 10, according to the present invention, is shown. The stringed musical instrument 10 is a guitar such as an electric guitar. It should be appreciated that the stringed musical instrument 10 may be a violin, banjo, cello or the like with either fretted or unfretted finger-boards.

The stringed musical instrument 10 includes a body 11, a bridge 12, and an elongated string support, generally indicated at 13 and according to the present invention, which extends outwardly away from the body 11. The stringed musical instrument 10 also includes a headstock 14 having a string tension adjusting mechanism 15, which in this instance is located at a distal end of the elongated string support 13. The stringed musical instrument 10 includes a plurality of strings 16 which are held at one end by the bridge 12 and at the other end by the string tension adjusting mechanism 15. It should be appreciated that, except for the elongated string support 13, the stringed musical instrument 10 is conventional and known in the art.

The elongated string support 13 includes a finger-board 17, which is provided with a nut 18, which serves as an outer suspension point for the strings 16. The strings 16 are suspended between the bridge 12 and the nut 18 in a manner which allows them to vibrate freely when they are plucked, strummed, bowed, or otherwise caused to vibrate in order to produce sound. The strings 16 extend in a parallel manner along the elongated string support 13 and finger-board 17 and are in close proximity thereto.

In accordance with the present invention, the elongated string support 13 includes a neck 20 and the finger-board 17 is attached to the neck 20 in a manner to be described. The neck 20 has a heel portion 22, a finger-board portion 24 extending axially from the heel portion 22, and a head portion 26 extending axially and away from the finger-board portion 24. The heel portion 22 is generally rectangular in shape and is of a size to be removably attached to the body 11 by suitable means such as fasteners (not shown,). The finger-board portion 24 has a spiral profile cut therein such that an upper surface 25 thereof is permanently set with the spiral progressively increasing from zero degrees (0°) at the heel portion 22 to an angle of less than approximately fifteen degrees (15°) at the nut 18 or beginning of the head portion 26. The head portion 26 follows the spiral profile and has a kickback of approximately four degree (4°). The neck 20 also has an elongated groove 28 extending from the heel portion 22 to the head portion 26. The neck 20 has at least one, preferably a plurality of recesses 30 disposed therein for a function to be described. The neck 20 is made of a rigid material, preferably wood. The neck 20 is a monolithic structure being integral, unitary, and one-piece. It should be appreciated that the neck 20 is not steamed or twisted so that there cannot be any weather induced spring back or movement therein. It should also be appreciated that the kickback of the head portion 26 eliminates the need for a string tree. It should further be appreciated that the neck 20 is in the form of a "bolt-on" attachment, which is detachably secured to the body 11 of the stringed musical instrument 10 by suitable means such as fasteners (not shown).

The elongated string support 13 includes the finger-board 17 attached to the neck 20. The finger-board 17 has a bottom surface 32 which contacts and mates with the upper surface 25 of the neck 20 and a top surface 34 which is contacted by the player of the stringed musical instrument 10. The finger-board 17 has a heel end 36 and extends axially to a nut end 38. The finger-board 17 has a spiral profile cut therein such that the top surface 34 thereof is permanently set with the spiral progressively increasing from zero degrees (0°) at the heel end 36 to an angle of less than fifteen degrees (15°) at the nut 18 or nut end 38. Preferably, the neck 20 and finger-board 17, which attached together, are longitudinally progressively spiraled from zero degrees (0°) at the heel thereof to an angle of approximately eleven degrees (11°), more preferably 10.8°, at the nut 18. It should be appreciated that the spiral profile may be in a clockwise or anti-clockwise direction, providing for both left-and right-hand players. It should also be appreciated that the term "spiraled" as used herein is defined to mean zero degrees (0°) at one end and rotated to a predetermined angle at the other end. It should be appreciated that the elongated string support 10 is not twisted at both ends thereof.

Figure 2:
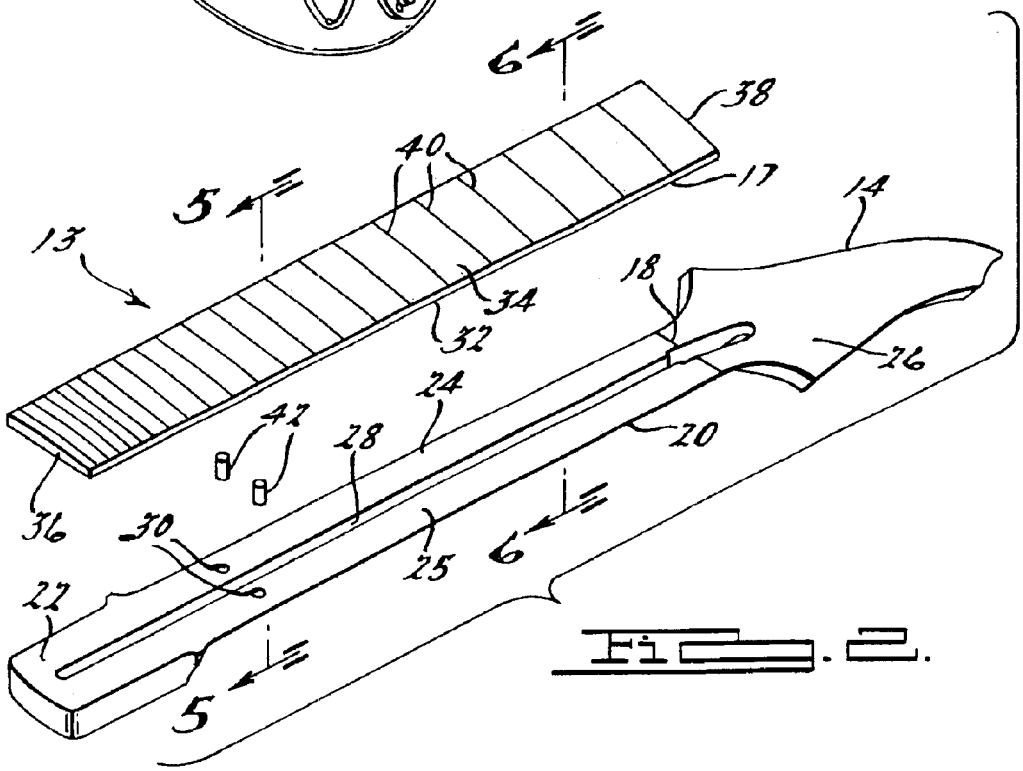
FIG. 2 is an exploded perspective view of the elongated string support of FIG. 1.
Figure 3:
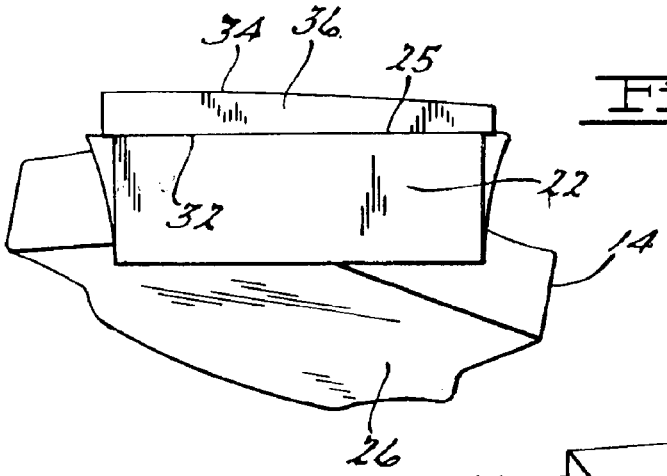
FIG. 3 is an elevational view of a heal end of the elongated string support of FIG. 1.
Figure 4:
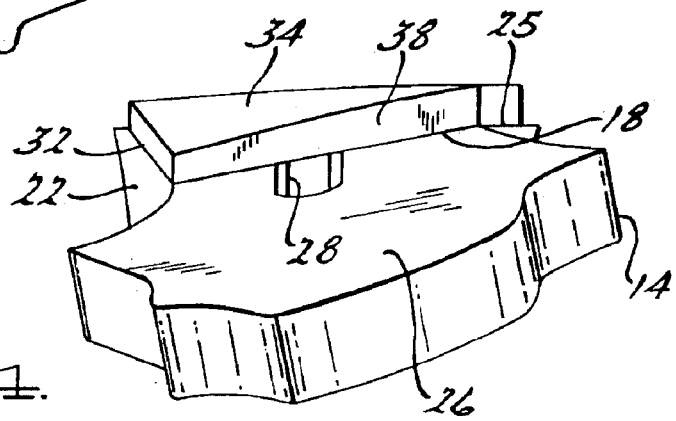
FIG. 4 is an elevational view of a nut end of the elongated string support of FIG. 1.
Figure 5:
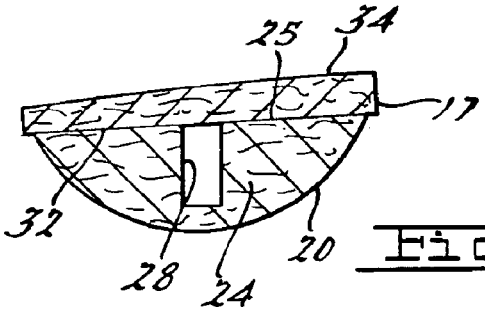
FIG. 5 is a sectional view taken along line 5—5 of FIG. 2.
Figure 6:
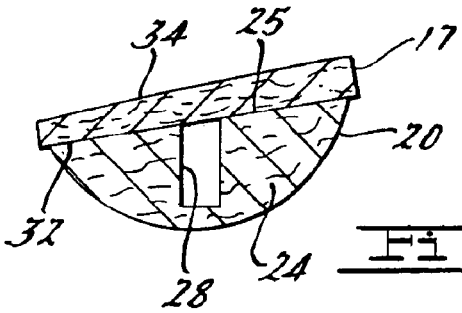
FIG. 6 is a sectional view taken along line 6—6 of FIG. 2.

As illustrated in FIGS. 1 and 2, the finger-board 17 may be provided with a series of spaced apart transverse frets 40 which are inserted into slots formed in the finger-board 17. It should be appreciated that the stringed musical instrument 10 may have either a flat or curved top surface for the frets 40, where present, generally follow the shape of the finger-board 17.

The finger-board 17 has a non-uniform radius for the top surface 38 thereof. As defined herein, a "non-uniform" radius is a compound radius as described herein. Preferably, the finger-board 17 has one end of a smaller radius as represented by a circle (not shown) and has the other end of a larger radius represented by a circle (not shown). Preferably, the smaller radius is at the nut end 38 and the larger radius is at the heel end 36. The smaller radius is two (2) inches to nine (9) inches and the larger radius is nine (9) inches to twelve (12) inches. Preferably, the smaller radius is seven (7) inches and the larger radius is twelve (12) inches. The remainder of the surface 34 the finger-board 17 between these two points is radiused to provide a uniform transition from the radius at one end to the other. Starting from the nut 18, each fret 40 toward the bridge 12 has a larger radius than the one above it, i.e., higher frets 40 closer to the bridge 12 are flatter than the frets 40 above them towards the nut 18. Such a surface 34 of the finger-board 17 is defined herein as a "compound radiused" surface. It should be appreciated that uniform height of the strings 16 throughout the fingerboard 17 is accomplished by the split compound fingerboard 17. It should also be appreciated that from fret 40 to fret 40, the radius changes slightly from its original twelve inch radius, thereby allowing for extremely low action setup and ease of playing.

The elongated string support 13 includes at least one, preferably a plurality of pins 42 such as dowels to attach the neck 20 and fingerboard 17 together. The pins 42 are disposed in the recesses 30 of the neck 20 and corresponding recesses (not shown) in the fingerboard 17. The fingerboard 17 and neck 20 are adhered together by suitable means such as an adhesive in a conventional manner to act as one unit. The elongated string support 13 also includes a truss rod (not shown) disposed in the groove 28, which is of a dual action type, to increase or decrease the amount of tension in the truss rod to keep the neck 20 straight. It should be appreciated that truss rod adjustment is accessible from an opening behind the nut 18.

In the elongated string support 13, the first fret 40 or nut 18 is moving down away from the low E string 16 looking from the heel portion 22 of the neck 20. The maximum difference between the low E string 16 and its relationship between the high E string 16 is 10.8 degrees of change. This degree of change starts from the heel portion 22 and gradually moves from zero degrees (0°) of change to its maximum degree of 10.8 degrees in the preferred embodiment. From side to side of the elongated string support 13, the low E string 16 is substantially on a flat or straight path just like a conventional neck and everything else from the low E string 16 falls away from there. Though the degree of change is 10.8 degrees total, the change between fret 40 to fret 40 is minimal. Visually, by looking down the elongated string support 13, the only noticeable change is at the nut 18 as it spirals from the heel portion 22. There is no difference.of degrees between the bridge 12 and the saddle 12 to the start of the elongated string support 13 as the string 16 moves toward the nut 18 for reference it is still zero degrees or flat. This allows the elongated string support 13 to be used as a replacement neck with any other type of bolt on guitar as there is no difference in the relationship between the bridge and heel on the guitar.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. An elongated string support for a stringed musical instrument comprising:

a neck having a heel portion, a head portion, and a finger-board portion extending axially between said heel portion and said head portion, said finger-board portion having a spiral profile from said heel portion to said head portion;

a finger-board attached to said neck and having a heel end and a nut end, said finger-board having a spiral profile from said heel end to said nut end; and said neck and said finger-board being zero degrees from a heel thereof and to a predetermined angle greater than zero degrees at a nut thereof.

2. An elongated string support for a stringed musical instrument comprising:

a neck having a heel portion, a head portion, and a finger-board portion extending axially between said heel portion and said head portion, said finger-board portion having a spiral profile from said heel portion to said head portion;

a finger-board attached to said neck and having a heel end and a nut end, said finger-board having a spiral profile from said heel end to said nut end;

said neck and said finger-board being zero degrees from a heel thereof and to a predetermined angle greater than zero degrees at a nut thereof; and wherein said spiral of said finger-board progresses from approximately zero degrees at said heel end to approximately fifteen degrees at said nut end.

3. An elongated string support for a stringed musical instrument comprising:

a neck having a heel portion for removable attachment to a body of the stringed musical instrument, a head portion, and a finger-board portion extending axially between said heel portion and said head portion, said finger-board portion having a spiral profile from said heel portion to said head portion;

a finger-board attached to said neck and having a heel end and a nut end, said finger-board having a spiral profile from said heel end to said nut end;

said neck and said finger-board being zero degrees from a heel thereof and to a predetermined angle greater than zero degrees at a nut thereof; and wherein said predetermined angle is less than approximately fifteen degrees.

4. An elongated string support for a stringed musical instrument comprising:

a neck having a heel portion, a head portion, and a finger-board portion extending axially between said heel portion and said head portion, said finger-board portion having a spiral profile from said heel portion to said head portion;

a finger-board attached to said neck and having a heel end and a nut end, said finger-board having a spiral profile from said heel end to said nut end;

said neck and said finger-board being zero degrees from a heel thereof and to a predetermined angle greater than zero degrees at a nut thereof; and wherein said head portion has a kickback angle of approximately four degrees.

5. An elongated string support as set forth in claim 1 wherein said finger-board has a non-uniform radius.

6. An elongated string support for a stringed musical instrument comprising:

a neck having a heel portion, a head portion, and a finger-board portion extending axially between said heel portion and said head portion, said finger-board portion having a spiral profile from said heel portion to said head portion;

a finger-board attached to said neck and having a heel end and a nut end, said finger-board having a spiral profile from said heel end to said nut end;

said neck and said finger-board being zero degrees from a heel thereof and to a predetermined angle greater than zero degrees at a nut thereof;

wherein said finger-board has a non-uniform radius; and wherein said non-uniform radius is a compound radius between said heel end and said nut end.

7. An elongated string support as set forth in claim 6 wherein said non-uniform radius has a radius of approximately two inches to approximately nine inches at said nut end and a radius of approximately nine inches to approximately twelve inches at said heel end.

8. An elongated string support as set forth in claim 1 wherein said neck is detachably connected to a body of the stringed musical instrument.

9. An elongated string support for a stringed musical instrument comprising:

a neck having a heel portion for removable attachment to a body of the stringed musical instrument, a head portion, and a finger-board portion extending axially between said heel portion and said head portion, said finger-board portion having a spiral profile from said heel portion to said head portion;

a finger-board attached to said neck and having a heel end and a nut end, said finger-board having a spiral profile from said heel end to said nut end;

said neck and said finger-board being zero degrees from a heel thereof and to a predetermined angle greater than zero degrees at a nut thereof; and wherein said neck has at least one recess therein.

10. An elongated string support as set forth in claim 9 including at least one pin disposed in said at least one recess to attach said finger-board to said neck.

11. An elongated string support for a stringed musical instrument comprising:

a neck for removable attachment to a body of the stringed musical instrument;

a finger-board attached to said neck having a spiral profile; and said spiral profile of said finger-board being zero degrees from a heel thereof and to a predetermined angle greater than zero degrees at a nut thereof.

12. An elongated string support as set forth in claim 11 wherein said neck has a heel portion, a head portion, and a finger-board portion extending axially between said heel portion and said head portion.

13. An elongated string support as set forth in claim 11 wherein and having a heel end and a nut end, said finger-board having said spiral profile from said heel end to said nut end.

14. An elongated string support as set forth in claim 13 wherein said spiral profile of said finger-board progresses from approximately zero degrees at said heel end to approximately fifteen degrees at said nut end.

15. An elongated string support for a stringed musical instrument comprising:

neck;

a finger-board attached to said neck having a spiral profile;

said spiral profile of said finger-board being zero degrees from a heel thereof and to a predetermined angle greater than zero degrees at a nut thereof;

wherein said neck has a heel portion, a head portion, and a finger-board portion extending axially between said heel portion and said head portion; and wherein said head portion has a kickback angle of approximately four degrees.

16. An elongated string support as set forth in claim 13 wherein said finger-board has a non-uniform radius.

17. An elongated string support for a stringed musical instrument comprising:

a neck;

a finger-board attached to said neck having a spiral profile;

said spiral profile of said finger-board being zero degrees from a heel thereof and to a predetermined angle greater than zero degrees at a nut thereof;

wherein and having a heel end and a nut end, said finger-board having said spiral profile from said heel end to said nut end;

wherein said finger-board has a non-uniform radius; and wherein said non-uniform radius is a compound radius between said heel end and said nut end.

18. An elongated string support as set forth in claim 17 wherein said non-uniform radius has a radius of approximately two inches to approximately nine inches at said nut end and a radius of approximately nine inches to approximately twelve inches at said heel end.

19. An elongated string support as set forth in claim 11 wherein said neck is detachably connected to a body of the stringed musical instrument.

20. A stringed musical instrument comprising:

a body having opposed ends;

a neck extending solely from one of said ends of said body and having a heel portion, a head portion, and a finger-board portion extending axially between said heel portion and said head portion, said finger-board portion having a spiral profile from said heel portion to said head portion;

a finger-board attached to said neck and having a heel end and a nut end, said finger-board having a spiral profile from said heel end to said nut end; and said neck and said finger-board being zero degrees from a heel thereof and to a predetermined angle greater than zero degrees at a nut thereof.

* * * * *

UNITED STATES PATENT AND TRADEMARK OFFICE

CERTIFICATE OF CORRECTION

PATENT NO. : 6,965,066 B1
APPLICATION NO. : 10/345109
DATED : November 15, 2005
INVENTOR(S) : Jeffrey J. Lace and Donald A. Lace, Jr.

It is certified that error appears in the above-identified patent and that said Letters Patent is hereby corrected as shown below:

Column 3, line 1 “heel-portion” should read -- heel portion --;
Column 3, line 23, “finger board” should read -- finger-board--;
Column 4, line 38, “degree” should read -- degrees --;
Column 5, line 26, “surface 34 the finger-board 17” should read -- surface 34 and the finger-board 17 --;
Column 5, line 35, “fingerboard” should read -- finger-board --;
Column 5, line 36, “fingerboard” should read -- finger-board --;
Column 5, line 42, “fingerboard” should read -- finger-board --;
Column 5, line 44, “fingerboard” should read -- finger-board -- in both occurrences; and
Column 8, Claim 15, line 3, “neck” should read -- a neck --.

Signed and Sealed this

Second Day of September, 2008

JON W. DUDAS
*Director of the United States Patent and Trademark Office*